US006996858B1

(12) United States Patent
York

(10) Patent No.: US 6,996,858 B1
(45) Date of Patent: Feb. 14, 2006

(54) TOILET SEAT APPARATUS

(76) Inventor: James G. York, 3837 S. 3100 East, Salt Lake City, UT (US) 84109

( * ) Notice: Subject to any disclaimer, the term of this patent is extended or adjusted under 35 U.S.C. 154(b) by 0 days.

(21) Appl. No.: 11/112,548

(22) Filed: Apr. 25, 2005

(51) Int. Cl.
*A47K 13/00* (2006.01)

(52) U.S. Cl. ..... 4/237; 4/235; 4/239; 4/241

(58) Field of Classification Search ..... 4/235, 4/237, 239, 241, 667
See application file for complete search history.

(56) References Cited

U.S. PATENT DOCUMENTS 1,097,015 A 5/1914 Graves
3,341,867 A 9/1967 Keen
4,181,988 A 1/1980 Skaggs
4,207,628 A 6/1980 Ibel
4,233,696 A 11/1980 Ibel
5,458,089 A * 10/1995 Rymer ..... 4/239
D368,518 S 4/1996 Giese et al.
5,787,514 A * 8/1998 Erli ..... 4/239

* cited by examiner

*Primary Examiner*—Tuan Nguyen

(57) ABSTRACT

A toilet seat apparatus includes a platform having upper and lower surfaces, a circular opening extending therethrough, an outer edge and an inner edge. Each of a pair of panels has a first end and a second end, and a first edge and a second edge. The panels are positioned on the platform. The first and second edges are arcuate such that the first edges may be aligned with the inner edge when the second edges are aligned with the outer edge. Each panel has top and bottom surfaces. A plurality of biasing members biases the panels upwardly away from the platform. Each biasing member extends between and is attached to the upper surface of the platform and the bottom surface of one of the panels. A plurality of guide members guides movement of the panels toward the outer edge of the platform as the panels move toward the platform.

10 Claims, 5 Drawing Sheets

TOILET SEAT APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to toilet seats and, more particularly, to a toilet seat apparatus for spreading the buttocks of a user.

2. Prior Art

In recent years, our western society has become more health conscious. However, today's toilet seats do not reflect this growing trend. Most conventional toilet seats are not contoured to fit the anatomy of the user's body. These seats make defecation difficult, instead of easy. As to size, even the elongated conventional seat barely gives adequate clearance lengthwise for the perineum and genitals of the average user. The conventional seat positions the thighs of the user relatively parallel to each other and parallel to the horizontal plane of the seat, thus making defecation most difficult, and in certain instances, as with obese individuals, leads to the soiling of the toilet user. A critical investigation and analytical discussion of the conventional toilet seat and requirements related to elimination and personal hygiene can be found in Alexander Kira's book, The Bathroom.

Prior art toilet seat constructions have offered new shapes for replacement of the conventional toilet seat. One group features a rear portion of the seat being sloped upwardly and rising above the normal surface of the seat to prevent the user to sit or lean backwards, urging him to bend forward at the waist. Another example encourages the user to spread their legs by making it uncomfortable to rest the thighs on a ridge detail on the inner sides of opposite front portions of the seat. Yet another example puts the user into a "squatting position" by featuring a seat structure of a curved or bowed construction. A final example has enlarged inwardly sloped opposite middle and front portions for supportive engagement of the user's thighs in the front portion of the seat with an enlarged rear portion and a narrow oblong front portion of its opening. These constructions do not spread the legs and do not provide an enlarged front portion of its opening to allow for the insertion of the hand for blotting.

Accordingly, a need remains for a toilet seat apparatus in order to overcome the above-noted shortcomings. The present invention satisfies such a need by providing a toiler seat apparatus that is easy, convenient and comfortable to use. Such a toilet seat apparatus provides large or obese persons with a toilet seat that accommodates their larger size. Instead of soiling themselves while using a standard seat, a larger person enjoys the comfort provided by the apparatus. The toilet seat apparatus effectively spreads the buttocks, thus ensuring a user does not soil them self. Such an apparatus is also ideal for handicapped individuals and persons with limited mobility. The toilet seat apparatus is produced from durable plastic for years of effective use.

BRIEF SUMMARY OF THE INVENTION

In view of the foregoing background, it is therefore an object of the present invention to provide a toilet seat apparatus. These and other objects, features, and advantages of the invention are provided by a toilet seat device for spreading the buttocks of a user.

To attain this, the present invention generally comprises an annular platform having a substantially planar upper and lower surface. The platform has a generally circular opening extending therethrough such that the platform has an outer edge and an inner edge. A pair of coextensive panels are elongated and have first end and a second ends. Each of the panels has a beveled first edge and a beveled second edge. The panels are positioned on the platform. Each of the first and second edges is arcuate such that the first edges may be aligned with the inner edge when the second edges are aligned with the outer edge. The panels each have a top surface and a bottom surface.

A plurality of biasing members bias the panels upwardly and away from the platform. Each of the biasing members extends between and is attached to the upper surface of the platform and the bottom surface of one of the panels such that the panels are positioned generally opposite of each other on the platform. A plurality of guide members guides movement of the panels toward the outer edge of the platform as the panels move toward the platform.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended thereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
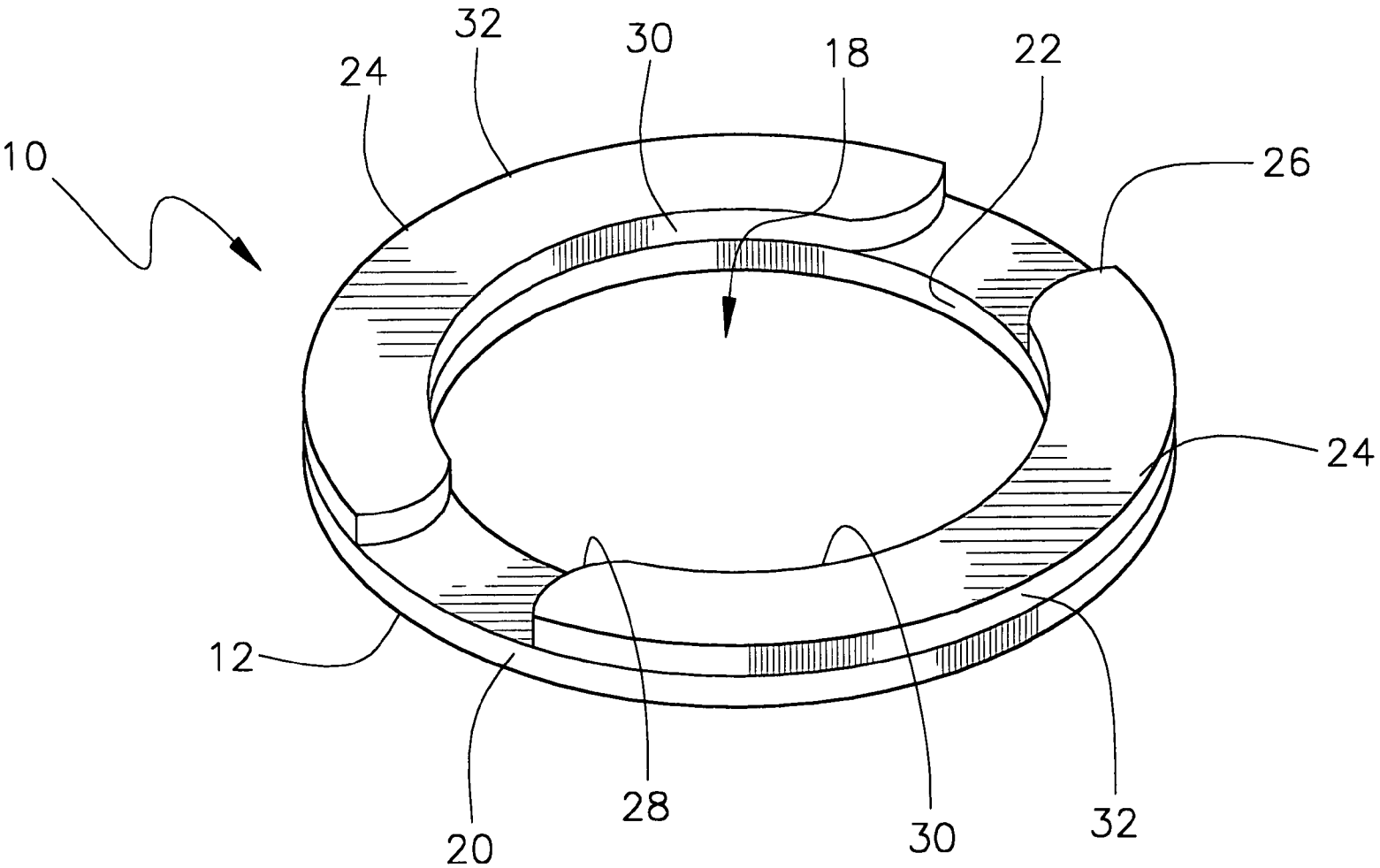
FIG. 1 is a perspective view showing a toilet seat apparatus, in accordance with the present invention.
Figure 2:
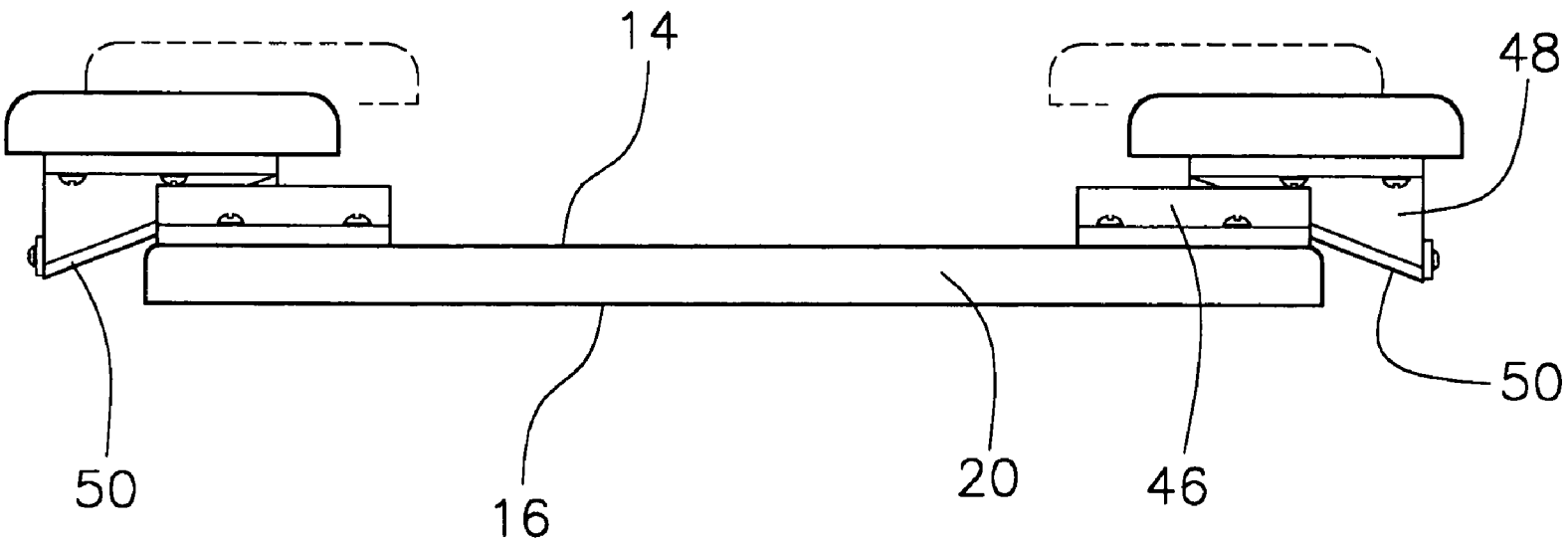
FIG. 2 is a front-elevational view of the apparatus shown in FIG. 1.
Figure 3:
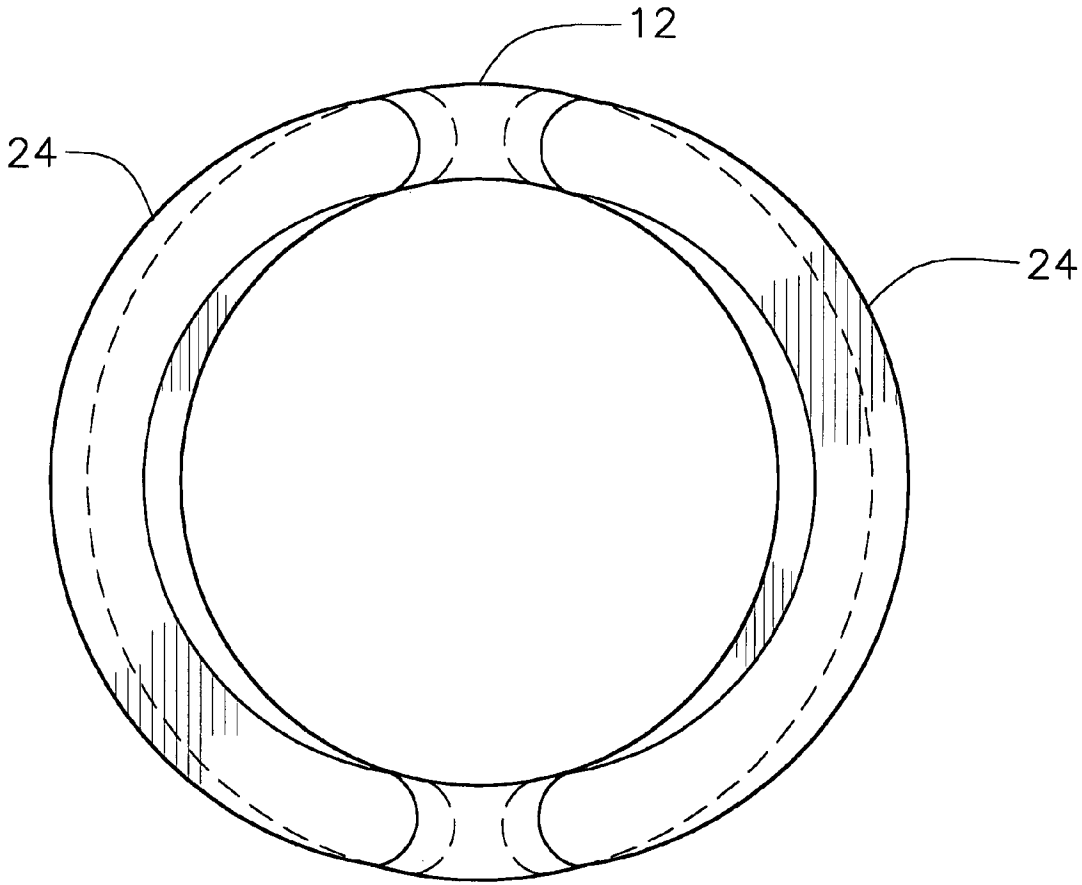
FIG. 3 is a top plan view of the apparatus shown in FIG. 1.
Figure 4:
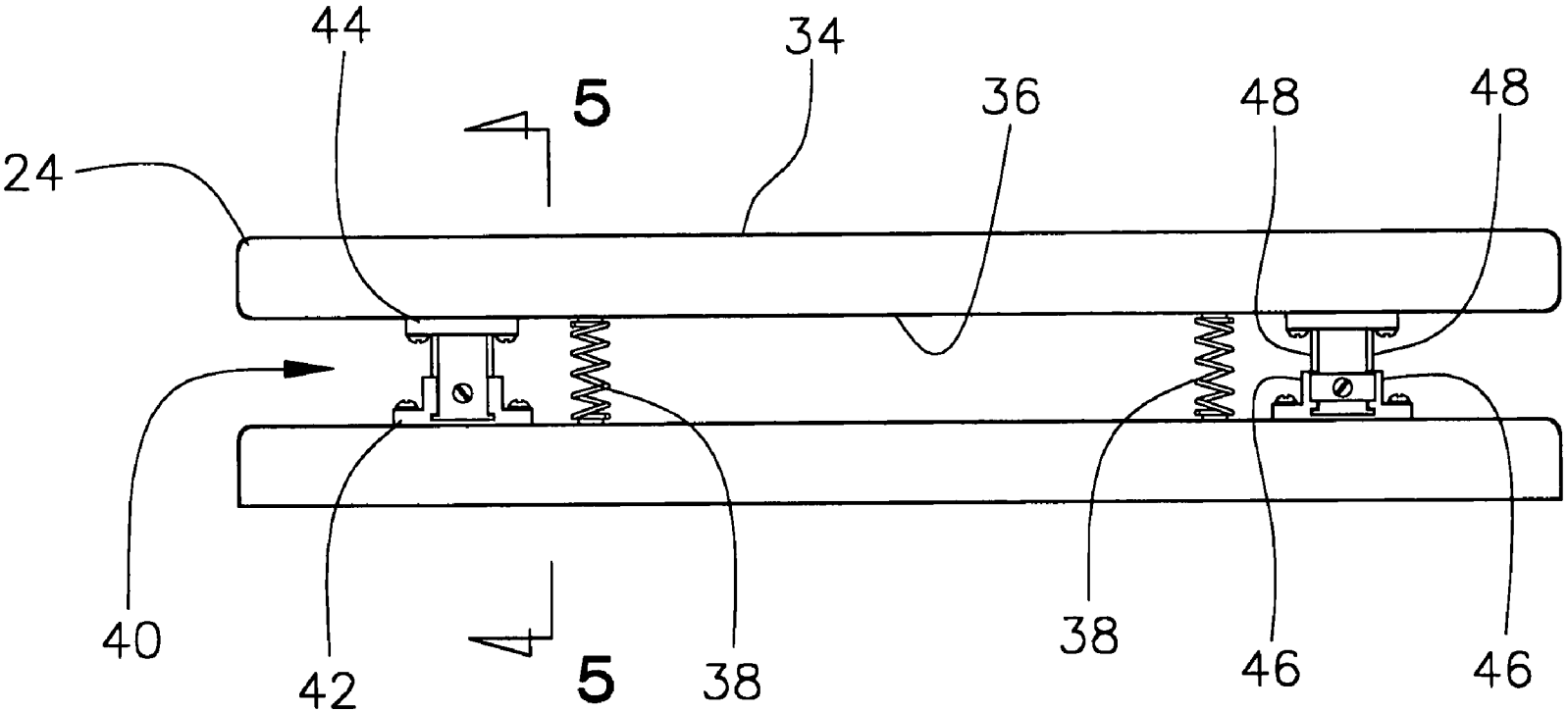
FIG. 4 is a side-elevational view of the apparatus shown in FIG. 1.
Figure 5:
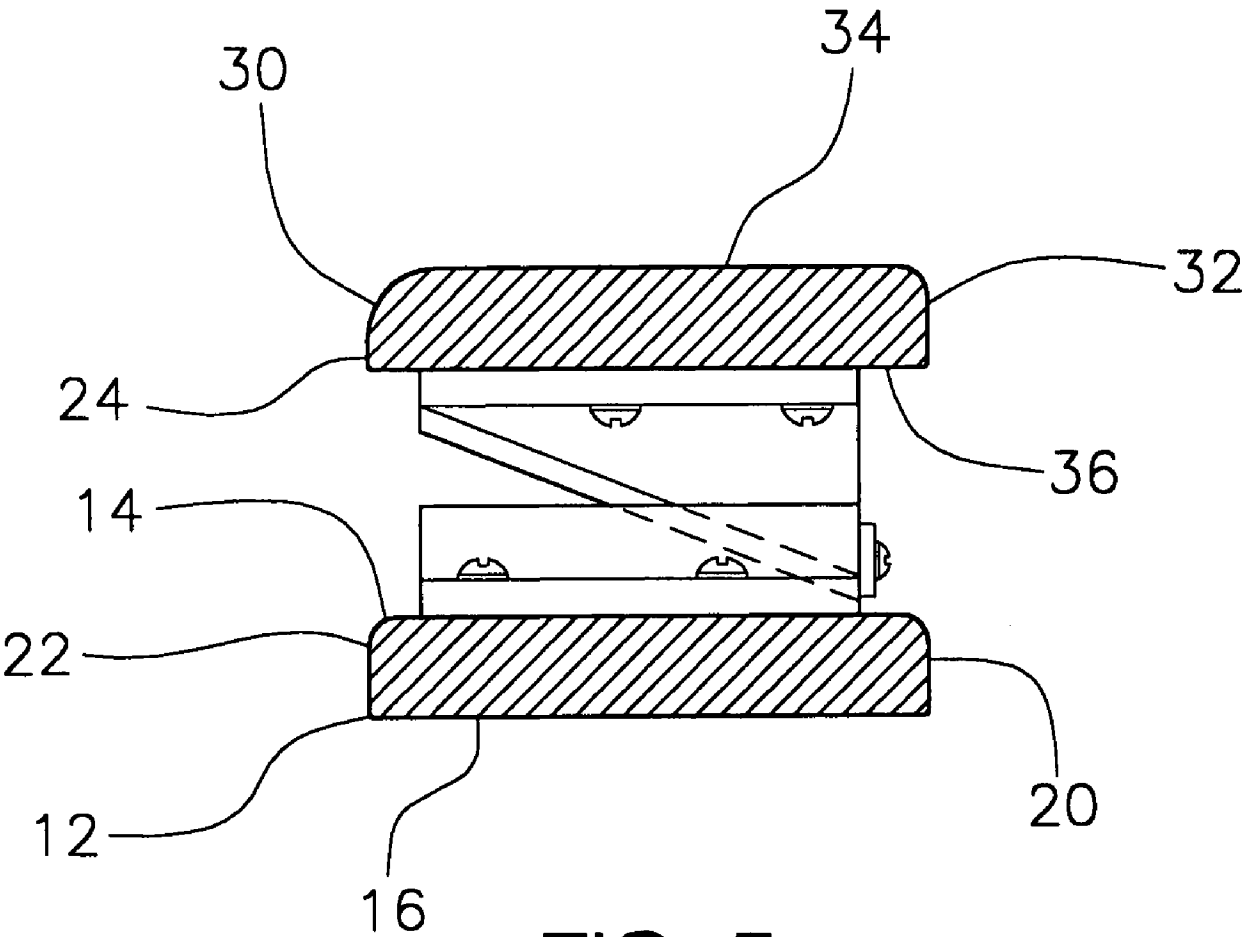
FIG. 5 is a cross-sectional view of the apparatus shown in FIG. 4, taken along line 5—5.

The apparatus of this invention is referred to generally in FIGS. 1–5 by the reference numeral 10 and is intended to provide a toilet seat apparatus. It should be understood that the apparatus 10 may be used to aid many different types of people when using the toilet and should not be limited to use by only large or obese persons.

Referring initially to FIGS. 1 through 5, the toilet seat apparatus 10 generally comprises an annular platform 12 having a substantially upper 14 and lower 16 surface. The platform 12 has a generally circular opening 18 extending therethrough such that the platform 12 has an outer edge 20 and an inner edge 22.

Each of a pair of coextensive panels 24 is elongated and has a first end 26 and a second end 28. Each of the panels 24 has a first edge 30 and a second edge 32. The panels 24 are positioned on the platform 12. Each of the first 30 and second 32 edges are beveled and have an arcuate shape such that the first edges 30 may be aligned with the inner edge 22 when the second edges 32 are aligned with the outer edge 20. The panels 24 each have a top surface 34 and a bottom surface 36.

A plurality of helical spring members 38 bias the panels 24 upwardly away from the platform 12. Each of the helical spring members 38 extends between, and is attached to, the upper surface 14 of the platform 12 and the bottom surface 36 of one of the panels 24 such that the panels 24 are positioned generally opposite of each other on the platform 12. The plurality of biasing means 38 preferably comprises four biasing means such that two biasing means are attached to each of the panels 24. Each of the biasing means 38 preferably comprises a spring.

A plurality of guide members 40 guide movement of the panels 24 toward the outer edge 20 of the platform 12 as the panels 24 move towards the platform 12. Each of the guide members 40 has a first portion 42 and a second portion 44. Each of the first portions 42 is attached to the platform 12 and each of the second portions 44 is attached to the bottom surface 36 of one of the panels 24.

The plurality of guide members 40 comprises four guide members 40 such that two guide members 40 are attached to each of the panels 24. Each of the first portions 42 includes a railing having a pair of spaced and parallel vertical walls 46 positioned on lines extending between the outer 20 and inner 22 edges. Each of the second portions 44 includes a pair of spaced and parallel lateral walls 48. Each of the second portions 44 is positioned within one of the first portions 42 such that each of the lateral walls 48 is abutting an inner surface of one of the vertical walls 46. The lateral walls 48 each have a bottom edge 50 angled downward from the first edge 30 of the panels 24 to the second edge 32 of the panels 24. The panels 24 extend outward from the inner edge 22 to the outer edge 20 when the panels 24 are moved toward the platform 12 as the bottom edges 50 move along the platform 12.

In use, the device 10 is positioned on a toilet bowl as would a conventional toilet seat. When a person sits on the device, particularly an overweight person, the panels move outward as they move down. This effectively spreads the buttocks of the person so that they do not soil themselves when using a toilet.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A toilet seat device for spreading the buttocks of a user, said toilet seat device comprising:

an annular platform having an upper surface and a lower surface, said platform having a generally circular opening extending therethrough such that said platform has an outer edge and an inner edge;

a pair of panels each being elongated and having a first end and a second end, each of said panels having a first edge and a second edge, each of said panels being positioned on said platform, each of said first and second edges being arcuate such that said first edges may be aligned with said inner edge when said second edges are aligned with said outer edge, said panels each having a top surface and a bottom surface;

a plurality of helical spring members, said helical spring member bias said panels upwardly away from said platform, each of said helical spring members extending between and being attached to said upper surface of said platform and said bottom surface of one of said panels such that said panels are positioned generally opposite of each other on said platform; and a plurality of guide members for guiding movement of said panels toward said outer edge of said platform as said panels move toward said platform.

2. The toilet seat device as in claim 1, wherein said plurality of helical spring members comprises four biasing means such that two biasing means are attached to each of said panels.

3. The toilet seat device as in claim 1, wherein each of said guide members having a first portion and a second portion, each of said first portions being attached to said platform and each of said second portions being attached to said bottom surface of one of said panels, said second portion being movable along said first portions.

4. The toilet seat device as in claim 1, wherein said plurality of guide members comprises: four guide members such that two guide members are attached to each of said panels.

5. The toilet seat device as in claim 3, wherein each of said first portions comprises: a railing having a pair of spaced and parallel vertical walls positioned on lines extending between said outer and inner edges, each of said second portions comprising a pair of spaced and parallel lateral walls, each of said second portions being positioned in one of said first portions such that each of said lateral walls is abutting an inner surface of one of said vertical walls, each of said lateral walls having a bottom edge angled downward from said first edge of said panels to said second edge of said panels, wherein said panels extend outward from said inner edge to said outer edge when said panels are moved toward said platform.

6. A toilet seat device for spreading the buttocks of a user, said toilet seat device comprising:

an annular platform having an upper surface and a lower surface, said platform having a generally circular opening extending therethrough such that said platform has an outer edge and an inner edge;

a pair of coextensive panels each being elongated and having a first end and a second end, each of said panels having a first edge and a second edge, each of said panels being positioned on said platform, each of said first and second edges being arcuate such that said first edges may be aligned with said inner edge when said second edges are aligned with said outer edge, each of said first and second edges being beveled, said panels each having a top surface and a bottom surface, said panels being coextensive and having an arcuate shape;

a plurality of helical spring members, said helical spring members bias said panels upwardly away from said platform, each of said helical spring members extending between and being attached to said upper surface of said platform and said bottom surface of one of said panels such that said panels are positioned generally opposite of each other on said platform; and a plurality of guide members for guiding movement of said panels toward said outer edge of said platform as said panels move toward said platform.

7. The toilet seat device as in claim 6, wherein said plurality of helical spring members are attached to said panels.

8. The toilet seat device of claim 6, wherein each of said guide members having a first portion and a second portion, each of said first portions being attached to said platform and each of said second portions being attached to said bottom surface of one of said panels, said second portion being movable along said first portions.

9. The toilet seat device as in claim 6, wherein said plurality of guide members are attached to said panels.

10. The toilet seat device as in claim 8, wherein each of said first portions comprises: a railing having a pair of spaced and parallel vertical walls positioned on lines extending between said outer and inner edges, each of said second portions comprising a pair of spaced and parallel lateral walls, each of said second portions being positioned in one of said first portions such that each of said lateral walls is abutting an inner surface of one of said vertical walls, each of said lateral walls having a bottom edge angled downward from said first edge of said panels to said second edge of said panels, wherein said panels extend outward from said inner edge to said outer edge when said panels are moved toward said platform.

* * * * *